US006030502A

United States Patent [19]

Meschenmoser

[11] Patent Number: 6,030,502

[45] Date of Patent: Feb. 29, 2000

[54] PRESS ARRANGEMENT

[75] Inventor: Andreas Meschenmoser, Horgenzell, Germany

[73] Assignee: Voith Sulzer Papiermaschinen GmbH, Heidenheim, Germany

[21] Appl. No.: 08/950,075

[22] Filed: Oct. 14, 1997

[30] Foreign Application Priority Data

Oct. 14, 1996 [DE] Germany ..... 196 42 401

[51] Int. Cl.[7] ..... D21F 3/02

[52] U.S. Cl. ..... 162/358.3; 162/361

[58] Field of Search ..... 162/358.3, 361; 100/153

[56] References Cited

U.S. PATENT DOCUMENTS

| | | | |
|---|---|---|---|
| 4,425,190 | 1/1984 | Cronin | 162/358.3 |
| 4,427,492 | 1/1984 | Cronin | 162/358.3 |
| 4,428,797 | 1/1984 | Cronin | 162/358.3 |
| 4,518,460 | 5/1985 | Hauser et al. | 162/361 |
| 4,555,305 | 11/1985 | Steiner et al. | 162/358.3 |
| 4,673,461 | 6/1987 | Roerig et al. | 162/358.3 |
| 4,917,767 | 4/1990 | Ilmarinen et al. | 162/358.3 |
| 4,931,142 | 6/1990 | Steiner et al. | 162/205 |
| 5,650,047 | 7/1997 | Meschenmoser | 162/358.3 |
| 5,650,048 | 7/1997 | Swietlik | 162/358.3 |

FOREIGN PATENT DOCUMENTS

| | | |
|---|---|---|
| 0066528 | 12/1982 | European Pat. Off. . |
| 3030233 | 2/1982 | Germany . |
| 3708189 | 9/1988 | Germany . |
| 8805966 | 10/1989 | Germany . |

*Primary Examiner*—Karen M. Hastings
*Attorney, Agent, or Firm*—Greenblum & Bernstein, P.L.C.

[57] ABSTRACT

Press arrangement for a machine for treating a fibrous pulp sheet. The press arrangement may include a shoe press roll having a flexible press sleeve, a mating roll having a mating roll axis, and a press nip extended in a run direction of the fibrous pulp sheet and formed between the shoe press roll and the mating roll. The press arrangement may also include a non-rotating carrier substantially extending across a machine width inside the flexible press sleeve, a press unit including at least one press shoe supported on the non-rotating carrier via at least one associated force element. The press unit exerts a force against the flexible press roll sleeve. The flexible press sleeve may be arranged to circulate around the non-rotating carrier and to be guided around the at least one press shoe in a press nip area. A portion of the flexible press sleeve, located outside of the press nip area, may circulate in a substantially circular-cylindrical path around a sleeve axis. A center plane of a resulting force exerted by the press unit may be positionally offset a distance in the run direction from a plane including the mating roll axis and the sleeve axis, and the press shoe may be positioned substantially symmetrical to the plane including the mating roll axis and the sleeve axis.

33 Claims, 1 Drawing Sheet

PRESS ARRANGEMENT

CROSS-REFERENCE TO RELATED APPLICATIONS

The present application claims priority under 35 U.S.C. § 119 of German Patent Application No. 196 42 401.1 filed Oct. 14, 1996, the disclosure of which is expressly incorporated by reference herein in its entirety.

BACKGROUND OF THE INVENTION

1. Field of the Invention

The present invention relates to a press arrangement for a machine for treating a fibrous pulp sheet, e.g., paper or cardboard, in a press nip (gap; opening) extending in a run direction of the fibrous pulp sheet. The press nip may be formed between a shoe press roll and a mating roll, the shoe press roll may include a flexible press sleeve circulating around a non-rotating carrier and guided around at least one press shoe of a press unit in a press nip area. The press unit may be supported on the carrier by at least one associated force element, preferably formed by a piston/cylinder unit. Outside of the press nip area, the press sleeve may be at least substantially circular-cylindrical and concentric with a sleeve axis. A plane formed at a position of a resulting force, e.g., a plane to which the at least one associated force element is substantially symmetrical, may be arranged substantially parallel to a connecting plane including the sleeve axis and the mating roll axis, and offset positioned in the run direction.

2. Discussion of Background Information

Press arrangements similar in general to the press arrangement discussed above are known in the art, e.g., from DE-A-37 08 189. Such press arrangements are used successfully in particular in press sections of paper or cardboard machines. The fibrous pulp sheet being drained is usually guided through the press nip together with at least one felt belt. A press nip, extended in a run direction of the fibrous pulp sheet, in particular has the advantage of a greater draining capacity. The interior of a press sleeve which, outside an area of the press nip is guided in at least substantially in a circular-cylindrical fashion, can be hermetically sealed toward the exterior, which eliminates risk of contamination from lubricating materials escaping outward. In addition, pressurized air can be fed into the interior of the press sleeve, inflating the press sleeve and thereby improving the smoothness of running. If the press sleeve is guided by rotatable supporting disks mounted on the carrier, the supporting disks and the interior pressure caused by the pressurized air causes the press sleeve circulating around the carrier to slide only over the press shoe, but otherwise to circulate free of any contact.

A common problem with such press arrangements is that the fibrous pulp sheet running out of the press nip may, for a while, have a joint run with the press sleeve and a felt belt before the fibrous pulp sheet detaches itself from the felt belt. Even when the joint run is only a relatively short stretch, there is a danger of an occurrence of a reverse moistening, i.e., in which the fibrous pulp sheet reabsorbs part of the fluids that had been previously drained off. The danger of such reverse moistening is increased by inflating the press sleeve, because after inflation, the joint run stretch is lengthened.

To solve this problem, in a press arrangement discussed in, e.g., DE-37 08 189, the rotational axis of the press sleeve and the two associated supporting disks may be offset against the run direction of the press sleeve relative to the press plane running through the axes of the carrier and the mating roll in the press arrangement. The offsetting of the rotational axis of the press sleeve and the associated supporting disks relative to the press plane is provided by a rotating path of the press sleeve that is eccentric to the carrier axis. The known press arrangement in particular exhibits the disadvantage that the respective guiding elements for the press sleeve, in particular with the supporting disks provided on the press sleeve ends, must be arranged eccentrically.

SUMMARY OF THE INVENTION

The present invention provides a press arrangement of the type generally discussed above which combines a substantially simpler construction and correspondingly greater reliability while ensuring the highest possible dry content of the fibrous pulp sheet running out of the press nip.

The present invention provides that an at least substantially circular-cylindrical rotating path of the press sleeve guided outside a press nip area may be concentric to a sleeve axis and that a press unit may be offset with its center plane in a run direction of the fibrous pulp sheet relative to a plane extending through an axis of the mating roll and an axis of the press sleeve roll.

Despite a substantially simpler construction and a correspondingly greater reliability with respect to the prior art press arrangements, the present invention provides a press arrangement in which the fibrous pulp sheet may detach itself from the felt belt running between the fibrous pulp sheet and the press sleeve at an early point beyond the press nip. In this manner, a minimal joint run stretch of the fibrous pulp belt, felt belt, and press sleeve is achieved, and the preferred minimal joint run may even approach zero. After the fibrous pulp sheet has been detached from the felt belt, e.g., immediately upon running out or exiting the press nip, reverse moistening of the fibrous pulp sheet is substantially eliminated. Further, in accordance with the present invention, optimal geometric conditions at an opening of the press nip result. That is, the press shoe, as viewed in the sheet run direction, may have a preceding curvature of a certain radius and may lie almost on the circular-cylindrical rotating path of press sleeve. Thus, a bulging of the fibrous pulp sheet may be substantially eliminated. If supporting disks are being used, simple mounting elements with coaxial centering- and bearing-surfaces can be used for this purpose.

The advantages of minimal reverse moistening may be utilized in two felt belts environments. In this manner, reverse moistening can be further minimized by correspondingly arranging or guiding the felt belts on both sides of the fibrous pulp sheet through the press opening.

It is advantageous if a distance measured in the press nip area, between the center plane of the press unit and the plane running through the mating roll and the sleeve axis, is, e.g., greater than approximately 10 mm, and in particular greater than approximately 15 mm, and preferably greater than approximately 20 mm.

In a particular embodiment of the present invention, the press shoe may include a hydrodynamically and/or hydrostatically lubricated contact surface facing the press sleeve and having a concave contact surface segment fitted to the mating roll.

It may be particularly advantageous to provide a contact surface of the press shoe with a convex contact surface segment on the intake side. For example, the convex contact surface segment may have a radius of curvature greater than approximately 30 mm, in particular greater than approximately 70 mm, and preferably approximately 100 mm. The radius of curvature may be selected such that the curvature lies at least nearly on, e.g., tangential to, the circular-cylindrical rotating path of the press sleeve. In this manner, danger of a bulging of the press sleeve may be substantially eliminated. The result, therefore, is a lesser bending of the press sleeve exterior. This feature is of a particular advantage with thick and double-coated press sleeve cloths. An additional benefit of this arrangement is a greater outflow resistance for lubrication oil before the press opening. Further, the intake may be less sensitive to transfer clots.

The contact surface of the press shoe may be preferably equipped with a convex contact surface segment on the outlet side having a radius of curvature, e.g., greater than approximately 12 mm, in particular greater than approximately 30 mm, and preferably approximately 50 mm. With such an enlarged shoe outlet radius, a clear decrease in a bending load of the press sleeve results. Again, this advantage is particularly noticed in double-coated cloth systems.

In accordance with another embodiment of the present invention, the press shoe may be associated with at least one force element pair. The two force elements may each be created or formed, e.g., preferably by a piston/cylinder unit and arranged in succession in the run direction of the fibrous pulp sheet. The force element pair may also be positioned symmetrical to the center plane of the press unit. The two force elements of a respective force element pair may each be pressurized, e.g., preferably individually and/or differently, relative to one another.

In this manner, the pressure profile, even during operation, may be controlled. Such a pressure profile adjustment may be used in all types of mating rolls, including, e.g., NIPCO rolls having monohydraulic systems.

Accordingly, the present invention is directed to a press arrangement for a machine for treating a fibrous pulp sheet. The press arrangement may include a shoe press roll having a flexible press sleeve, a mating roll having a mating roll axis, and a press nip extended in a run direction of the fibrous pulp sheet and formed between the shoe press roll and the mating roll. The press arrangement may also include a non-rotating carrier substantially extending across a machine width inside the flexible press sleeve, a press unit including at least one press shoe supported on the non-rotating carrier via at least one associated force element. The press unit exerts a force against the flexible press roll sleeve. The flexible press sleeve may be arranged to circulate around the non-rotating carrier and to be guided around the at least one press shoe in a press nip area. A portion of the flexible press sleeve, located outside of the press nip area, may circulate in a substantially circular-cylindrical path around a sleeve axis. A center plane of a resulting force exerted by the press unit may be positionally offset a distance in the run direction from a plane including the mating roll axis and the sleeve axis, and the press shoe may be positioned substantially symmetrical to the plane including the mating roll axis and the sleeve axis.

In accordance with another feature of the present invention, the offset distance may be greater than approximately 10 mm. Further, the offset distance may be greater than approximately 15 mm. Still further, the offset distance may be greater than approximately 20 mm.

In accordance with another feature of the present invention, the press shoe may include at least one lubricated contact surface positioned to face the press sleeve, and the at least one lubricated contact surface may include a concave contact surface segment shaped to fit the mating roll. Further, the at least one lubricated contact surface may include at least one of a hydrodynamically and hydrostatically lubricated contact surface.

In accordance with still another feature of the present invention, the at least one lubricated contact surface may have a convex contact surface segment positioned on an uptake side of the press shoe, and the convex contact surface segment may have a radius of curvature greater than approximately 30 mm. Further, the radius of curvature of the uptake side convex contact surface may be greater than approximately 70 mm. Still further, the radius of curvature of the uptake side convex contact surface may be approximately 100 mm.

In accordance with a further feature of the present invention, the at least one contact surface may have a convex contact surface segment positioned on an outlet side of the press shoe, and the convex contact surface segment may have a radius of curvature greater than approximately 12 mm. Further, the radius of curvature of the outlet side convex contact surface may be greater than approximately 30 mm. Still further, the radius of curvature of the outlet side convex contact surface may be approximately 50 mm.

In accordance with a still further feature of the present invention, the at least one force element may include at least one force element pair having two force elements successively positioned in the run direction and positioned symmetrically to the center plane. Further, a pressurized medium may be associated with each of the two force elements to actuate the force elements. Each of the two force elements are at least one of individually and differently pressurized.

In accordance with another feature of the present invention, the fibrous pulp sheet may include one of a paper and cardboard sheet.

In accordance with still another feature of the present invention, the force element may include a piston/cylinder unit.

In accordance with a further feature of the present invention, the press arrangement may include a lateral stop that prevents the press shoe from at least one of swerving, twistin, and breaking out.

In accordance with a still further feature of the present invention, the press shoe may include an uptake end having a first radius of curvature and an outlet end having a second radius of curvature. The portion of the flexible press sleeve circulating in a substantially circular-cylindrical path may tangentially contact the first and second radii of curvature. In this manner, bulging of the press sleeve may be substantially prevented.

The present invention is also directed to a shoe press roll for use in a machine for treating a fibrous pulp sheet. The shoe press roll may form a portion of a nip extended in a roll rotation direction, and the shoe press roll may include a carrier extending across a width of the shoe press roll, a press unit having at least one force element, at least one press shoe coupled to the press unit and supported on the carrier, and a flexible press roll sleeve guided over the at least one press shoe and including a substantially cylindrical portion located outside of the press nip and arranged substantially concentrically with a sleeve axis. The at least one press shoe may include a press shoe plane of symmetry vertically extending through the flexible press roll sleeve and including the sleeve axis, and the press unit may include a press unit plane of symmetry substantially parallel to the press shoe plane of symmetry that may be positionally offset by a distance in the roll rotation direction.

In accordance with another feature of the present invention, the at least one force element may include two force elements successively arranged in the roll rotation direction.

In accordance with another feature of the present invention, the two force elements may include independently actuatable piston/cylinder units. Further, each of the independent actuatable piston/cylinder units may be supplied with pressurized fluid at different pressures.

In accordance with still another feature of the present invention, the press shoe may include a contact surface for contacting an interior surface of the flexible press roll sleeve. The contact surface may be shaped to complement a mating roll.

In accordance with a further feature of the present invention, the press shoe may include a contact surface for contacting an interior surface of the flexible press roll sleeve. The contact surface may have a concave shape. Further, the contact surface may include at least one of a hydrodynamically and hydrostatically lubricated contact surface.

In accordance with still another feature of the present invention, the press shoe further includes a convex entry contact surface positioned on an entry side of the press shoe having a radius of curvature greater than approximately 30 mm.

In accordance with a still further feature of the present invention, the press shoe flirter includes a convex exit contact surface positioned on an exit side of the press shoe having a radius of curvature greater than approximately 12 mm.

In accordance with another feature of the present invention, the press shoe further includes a convex exit contact surface positioned on an exit side of the press shoe shaped to decrease a bending load of the flexible press sleeve.

In accordance with a further feature of the present invention, an exit contact surface may be positioned on an exit side of the press shoe shaped to substantially eliminate reverse moistening of the fibrous paper sheet.

In accordance with yet another feature of the present invention, the fibrous press roll may include one of a paper and cardboard sheet.

In accordance with still another feature of the present invention, a stop element may be positioned adjacent a outlet edge of the press shoe.

In accordance with yet another feature of the present invention, the stop element is adapted to contact the outlet edge of the press shoe during operation of the shoe press roll.

Other exemplary embodiments and advantages of the present invention may be ascertained by reviewing the present disclosure and the accompanying drawing FIGURE.

BRIEF DESCRIPTION OF THE DRAWINGS

The present invention is further described in the detailed description which follows, in reference to the noted drawing by way of non-limiting examples of preferred embodiments of the present invention, and wherein:

The FIGURE illustrates a schematic, partial section display of a press arrangement for in accordance with the present invention.

DETAILED DESCRIPTION OF THE INVENTION

Figure 1:
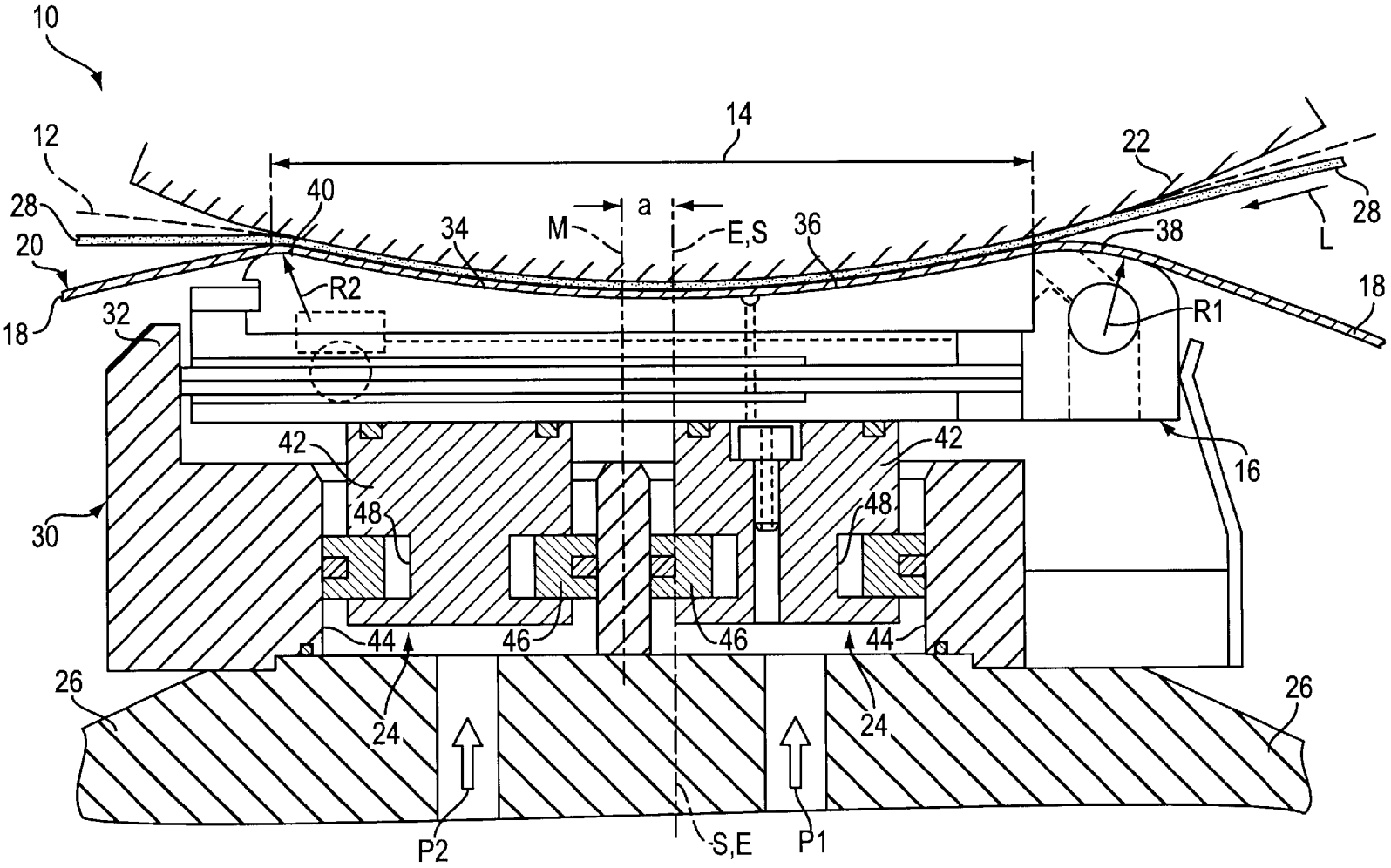

The particulars shown herein are by way of example and for purposes of illustrative discussion of the present invention only and are presented in the cause of providing what is believed to be the most usefull and readily understood description of the principles and conceptual aspects of the invention. In this regard, no attempt is made to show structural details of the invention in more detail than is necessary for the fundamental understanding of the invention, the description taken with the drawings making apparent to those skilled in the art how the several forms of the invention may be embodied in practice.

The FIGURE illustrates a purely schematic representation of a press arrangement 10 for a machine to treat a fibrous pulp sheet 12, e.g., a paper or cardboard sheet, in a press nip (gap; opening) 14 that extends in a sheet run direction L.

In the exemplary embodiment illustrated in the FIGURE, the extended press nip 14 may be defined or formed by a lower and an upper press surface. The lower press surface defining a bottom portion of press nip 14 may be formed by a flexible press sleeve 18 of a bottom shoe press roll 20 guided over at least one press shoe 16. Opposite bottom shoe press roll 20 is a cylindrical mating roll 22, which correspondingly forms the upper press surface defining a top portion of press nip 14. Cylindrical mating roll 22 may include, e.g., a stiff roll sleeve. However, the upper press surface may be alternatively formed with a press sleeve guided over at least one press shoe or similar device.

An interior surface of flexible press sleeve 18 of lower shoe press roll 20 may be pressed by press shoe 16 to press the outer surface against the opposing press surface formed by cylindrical mating roll 22. In this regard, a fluid pillow may be produced between press shoe 16 and the interior surface of press sleeve 18. Press shoe 16 may be pressed against cylindrical mating roll 22 via a plurality of force elements created or formed by respective piston/cylinder units 24. The plurality of force elements may be supported underneath by a non-rotating carrier 26 of shoe press roll 20 to facilitate circulation of flexible press sleeve 18 around non-rotating carrier 26.

A felt belt 28, which may be utilized for drainage, may be guided through press nip 14 with fibrous pulp sheet 12 to be treated. As shown in the exemplary embodiment, felt belt 28 may be positioned between fibrous pulp sheet 12 and shoe press roll 20. Thus, fibrous pulp sheet 28 may directly contact the surface of cylindrical mating roll 22. Alternatively, another felt belt (not shown) may be guided through press nip 14 such that fibrous pulp sheet 12 is arranged between the felt belts. In a further alternative, a plurality of drainage felts may be provided such that drainage felts are positioned on both sides of the fibrous pulp sheet being treated.

Press shoe 16 and piston/cylinder units 22 associated with press shoe 16 may form at least a part of a press unit 30. Press unit 30 may also include a stop 32 that press shoe 16 may be pressed against during operation of press arrangement 10 to maintain a position center of press shoe 16 with respect to a connecting line or plane between an axis of mating roll 22 and an axis of press sleeve 18 (not shown).

Press sleeve 18 may be guided over press shoe 16 in an area of the press nip 14, i.e., in a press nip area, to circulate around non-rotating carrier 26. However, outside of the press nip area, press sleeve 18 may be guided in at least a substantially circular-cylindrical fashion or path concentric with the axis of the press sleeve 18.

The axis of press sleeve 18 may be positioned in a plane of symmetry S of press shoe 16 and an axis of cylindrical mating roll 22 may be positioned in a vertical plane E. In accordance with the exemplary embodiment of the present invention, plane of symmetry E containing the axis of cylindrical mating roll 22 may coincide with plane of symmetry S of press shoe 16 containing the axis of press sleeve 18. A center plane M of press unit 30, e.g., at a position at which a resulting force is exerted by press unit 30, may be formed as a line of symmetry between the piston/cylinder pairs, and may be substantially parallel to vertical plane E (and S) running through the axes of cylindrical mating roll 22 and press sleeve 18. The two piston/cylinder units 24 of the piston/cylinder pair may be successively arranged in run direction L.

The rotating path of press sleeve 18, at least the portion that is substantially in a circular-cylindrical fashion or path outside the press nip area, may be concentric to the press sleeve axis. However, center plane M of press unit 30 may be offset, in run direction L, from plane E (and S) running through the axes of cylindrical mating roll 22 and the press sleeve axis. In the exemplary embodiment, center plane M of press unit 30 may be offset downstream, relative to run direction L, of plane E (and S). For example, in the exemplary embodiment, a distance a between center plane M and plane E (and S) may be greater than approximately 20 mm.

In an alternative to the exemplary embodiment, it is also conceivable that center plane M of press unit 30 may be tilted toward plane E (and S) running through the axis of the mating roll 22 and the press sleeve axis. In this alternative, the distance measured in the area of press nip 14, i.e., between center plane M and plane E (and S) may be, e.g., greater than approximately 10 mm, preferably greater than approximately 15 mm, and most preferably greater than approximately 20 mm.

Press shoe 16 may include at least one of a hydrodynamically and hydrostatically lubricated contact surface 34 having a concave contact surface segment 36 fitted to or complementary with the outer surface of cylindrical mating roll 22. Concave contact surface segment 36 is positioned to face the interior surface of press sleeve 18.

Contact surface 34 of press shoe 16 may be equipped or provided with a convex contact surface segment 38 on the intake or entry side of press nip 14. Convex contact surface segment 38 may be formed with a radius of curvature R1 of, e.g., greater than approximately 30 mm, preferably greater than approximately 70 mm, and most preferably approximately 100 mm. Further, contact surface 34 of press shoe 16 may also be equipped or provided with a convex contact surface segment 40 on an outlet or exit side of press nip 14. Convex contact surface segment 40 may be formed with a radius of curvature R2 of, e.g., greater than approximately 12 mm, preferably greater than approximately 30 mm, and most preferably approximately 50 mm.

As discussed above, press shoe 16 may be associated with at least one force element pair having two force elements formed by piston/cylinder units 24 successively arranged in run direction L and symmetrically to center plane M. The two piston/cylinder units 24 each may include a piston 42 coupled with press shoe 16, and a cylinder 44 for receiving piston 42. Piston 42 may be guided in cylinder 44 via a respective sealing disk 46 positioned within a circumferential notch 48. In this manner, piston 42 may be radially slidable within cylinder 44. The two piston/cylinder units 24 of a respective force element pair may each be pressurized individually and/or differently, relative to each another. That is, one of the piston/cylinder units 24 may be pressurized with a pressure P1 and the other of the piston/cylinder units 24 may be pressurized with a pressure P2. As noted above, P1 and P2 may be different and each pressure may be individually actuated. As noted above, the resulting force of P1 and P2 may be exerted substantially at center plane M of press unit 30.

Because the double-piston press utilizes pressures that can be variably controlled with respect to each other, the acting line of a resulting shoe press force is not fixed. Thus, the cylinder press force does not form a straight line with the press force of mating roll. Rather, a resulting shoe support force may be composed of a piston force and a horizontal thrust force. The horizontal thrust force counteracts the bending tendency of press shoe 16 due to thermal effects and the frictional forces that may occur between press sleeve 18 and press shoe 16 during operation of press arrangement 10. Accordingly, during operation, press shoe 16 must be pressed against stop 32 with a greater force than a maximal inner bending force, and thus kept straight.

Press sleeve 18 may be secured on its ends to supporting disks which may be rotatably mounted on carrier 26 and concentric to the press sleeve axis.

Because center line M of press unit 30 may be offset from plane E (and S) containing the axes of cylindrical mating roll 22 and press sleeve axis, press sleeve 18 may run relatively steeply downward immediately after exiting press nip 14. This advantageously results in fibrous pulp sheet 12 and felt belt 28 detaching themselves from each other at a minimal distance from the outlet of press nip 14. If the alternative of a plurality of felt belts is utilized, the same principle applies and fibrous pulp sheet 12 and each of the felt belts may be detached with a minimal distance from the exit of press nip 14. By substantially immediately separating fibrous pulp sheet 12 and felt belt 28 upon exiting press nip 14, water pressed out of fibrous pulp sheet 12 and into the felt belts in press nip 14 cannot flow back into the fibrous pulp sheet 12 after leaving press nip 14. Thus, a reverse moistening of fibrous pulp sheet 12 may be substantially avoided.

Thus, a highest possible dry content of fibrous pulp sheet 12 running out of press nip 14 may be ensured with a substantially simpler construction and correspondingly greater reliability. In addition, the present invention provides optimal geometrical conditions in the intake area of press nip 14. That is, the leading shoe radius lies nearly on the circular-cylindrical rotating path of press sleeve 18. Thus, a bulging of press sleeve 18 may be avoided. Further, with the relatively large radius of curvature R1 of the contact surface segment 38 located on the intake side of press shoe 16, less bending of press sleeve 14 or cloth on the exterior may occur. This feature may be particularly important when utilizing thicker, double-coated cloths. In addition, a greater outflow resistance for the lubrication oil in front of press nip 14 may result and the intake of press nip 14 may be less sensitive to transfer clots.

Because contact surface segment 40 of press shoe 16 exhibits a relatively large radius of curvature R2 on the outlet side of press nip 14, bending stress of press sleeve 18 may be decreased. This feature may also be particularly important when utilizing double-coated press sleeves.

It is noted that the foregoing examples have been provided merely for the purpose of explanation and are in no way to be construed as limiting of the present invention. While the invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the invention in its aspects. Although the invention has been described herein with reference to particular means, materials and embodiments, the invention is not intended to be limited to the particulars disclosed herein; rather, the invention extends to all functionally equivalent structures, methods and uses, such as are within the scope of the appended claims.

Reference List

10 press arrangement
12 fibrous pulp sheet
14 press nip
16 press shoe
18 press sleeve
20 shoe press roll
22 mating roll
24 piston/cylinder unit
26 carrier
28 felt belt
30 press unit
32 stop
34 contact surface
36 concave contact surface segment
38 convex contact surface segment
40 convex contact surface segment
42 piston
44 cylinder
46 sealing disk
48 circumferential notch
a distance
E vertical plane
L run direction
M center plane
R1 radius of curvature
R2 radius of curvature
S plane of symmetry

What is claimed:

1. A press arrangement for a machine for treating a fibrous pulp sheet comprising:

a shoe press roll having a flexible press sleeve;

a mating roll having a mating roll axis;

a press nip extended in a run direction of the fibrous pulp sheet and formed between the shoe press roll and the mating roll;

a non-rotating carrier substantially extending across a machine width inside the flexible press sleeve;

a press unit including at least one press shoe supported on the non-rotating carrier via at least one associated force element, the press unit for exerting a force against the flexible press sleeve;

the flexible press sleeve arranged to circulate around the non-rotating carrier and to be guided around the at least one press shoe in a press nip area, a portion of the flexible press sleeve, located outside of the press nip area, circulating in a substantially circular-cylindrical path around a sleeve axis;

a center plane of a resulting force exerted by the press unit being positionally offset a distance in the run direction from a plane including the mating roll axis and the sleeve axis;

the press shoe being positioned substantially symmetrical to the plane including the mating roll axis and the sleeve axis;

the press unit further including a lateral stop positioned to restrict horizontal movement of the press shoe; and the press shoe being forced against the lateral stop due to a horizontal component of the resulting force.

2. The press arrangement in accordance with claim 1, the offset distance being greater than approximately 10 mm.

3. The press arrangement in accordance with claim 2, the offset distance being greater than approximately 15 mm.

4. The press arrangement in accordance with claim 2, the offset distance being greater than approximately 20 mm.

5. The press arrangement in accordance with claim 1, the press shoe comprising at least one lubricated contact surface positioned to face the press sleeve; and the at least one lubricated contact surface including a concave contact surface segment shaped to fit the mating roll.

6. The press arrangement in accordance with claim 5, the at least one lubricated contact surface comprising at least one of a hydrodynamically and hydrostatically lubricated contact surface.

7. The press arrangement in accordance with claim 5, the at least one lubricated contact surface having a convex contact surface segment positioned on an uptake side of the press shoe; and the convex contact surface segment having a radius of curvature greater than approximately 30 mm.

8. The press arrangement in accordance with claim 7, the radius of curvature of the uptake side convex contact surface being greater than approximately 70 mm.

9. The press arrangement in accordance with claim 7, the radius of curvature of the uptake side convex contact surface being approximately 100 mm.

10. The press arrangement in accordance with claim 5, the at least one contact surface having a convex contact surface segment positioned on an outlet side of the press shoe; and the convex contact surface segment having a radius of curvature greater than approximately 12 mm.

11. The press arrangement in accordance with claim 10, the radius of curvature of the outlet side convex contact surface being greater than approximately 30 mm.

12. The press arrangement in accordance with claim 10, the radius of curvature of the outlet side convex contact surface being approximately 50 mm.

13. The press arrangement in accordance with claim 1, the at least one force element comprising at least one force element pair having two force elements successively positioned in the run direction and positioned symmetrically to the center plane.

14. The press arrangement in accordance with claim 13, further comprising a pressurized medium for associated with each of the two force elements to actuate the force elements, wherein each of the two force elements are at least one of individually and differently pressurized.

15. The press arrangement in accordance with claim 1, the fibrous pulp sheet comprising one of a paper and cardboard sheet.

16. The press arrangement in accordance with claim 1, the force element comprising a piston/cylinder unit.

17. The press arrangement in accordance with claim 1, the lateral stop further positioned to prevent the press shoe from at least one of swerving and breaking out.

18. The press arrangement in accordance with claim 1, the press shoe comprising an uptake end having a first radius of curvature and an outlet end having a second radius of curvature; and the portion of the flexible press sleeve circulating in a substantially circular-cylindrical path tangentially contacts the first and second radii of curvature, whereby bulging of the press sleeve is substantially prevented.

19. A shoe press roll for use in a machine for treating a fibrous pulp sheet, the shoe press roll for forming a portion of a nip extended in a roll rotation direction, the shoe press roll comprising:

a carrier extending across a width of the shoe press roll;

a press unit including at least one force element and a stop element;

at least one press shoe coupled to the press unit and supported on the carrier;

a flexible press roll sleeve guided over the at least one press shoe and including a substantially cylindrical portion located outside of the press nip and arranged substantially concentrically with a sleeve axis;

the at least one press shoe comprising a press shoe plane of symmetry vertically extending through the flexible press roll sleeve and including the sleeve axis; and the press unit comprising a press unit plane of symmetry substantially parallel to the press shoe plane of symmetry and positionally offset from the press shoe plane of symmetry by a distance in the roll rotation direction, wherein the press unit is adapted to apply a pressing force; and the press unit is movable via a horizontal component of the pressing force so as to be in contact with the stop element.

20. The shoe press roll in accordance with claim 19, the at least one force element comprising two force elements successively arranged in the roll rotation direction.

21. The shoe press roll in accordance with claim 20, the two force elements comprising independently actuatable piston/cylinder units.

22. The shoe press roll in accordance with claim 21, each of the independent actuatable piston/cylinder units being supplied with pressurized fluid at different pressures.

23. The shoe press roll in accordance with claim 19, the press shoe comprising a contact surface for contacting an interior surface of the flexible press roll sleeve, the contact surface being shaped to complement a mating roll.

24. The shoe press roll in accordance with claim 19, the press shoe comprising a contact surface for contacting an interior surface of the flexible press roll sleeve, the contact surface having a concave shape.

25. The shoe press roll in accordance with claim 24, the contact surface comprising at least one of a hydrodynamically and hydostatically lubricated contact surface.

26. The shoe press roll in accordance with claim 24, the press shoe further comprising a convex entry contact surface positioned on an entry side of the press shoe having a radius of curvature greater than approximately 30 mm.

27. The shoe press roll in accordance with claim 24, the press shoe further comprising a convex exit contact surface positioned on an exit side of the press shoe having a radius of curvature greater than approximately 12 mm.

28. The shoe press roll in accordance with claim 24, the press shoe further comprising a convex exit contact surface positioned on an exit side of the press shoe shaped to decrease a bending load of the flexible press sleeve.

29. The shoe press roll in accordance with claim 24, the press shoe further comprising an exit contact surface positioned on an exit side of the press shoe shaped to substantially eliminate reverse moistening of the fibrous paper sheet.

30. The shoe press roll in accordance with claim 19, the fibrous press roll comprising one of a paper and cardboard sheet.

31. The shoe press roll in accordance with claim 19, the stop element being positioned adjacent an outlet edge of the press shoe.

32. The shoe press roll in accordance with claim 31, the stop element adapted to contact the outlet edge of the press shoe during operation of the shoe press roll.

33. The shoe press roll in accordance with claim 19, the stop element being positioned to maintain a position of the press shoe plane of symmetry during a loading of the press shoe.

* * * * *